US008505218B2

(12) United States Patent
Angiulo et al.

(10) Patent No.: US 8,505,218 B2
(45) Date of Patent: Aug. 13, 2013

(54) SHOE HAVING REMOVABLE AND INTERCHANGEABLE HEEL ASSEMBLIES WITH KIT

(75) Inventors: Barbara-Jay Angiulo, Lynn, MA (US); Michael P. Rodrigues, Quincy, MA (US)

(73) Assignee: Barbara-Jay's, LLC, Lynn, MA (US)

( * ) Notice: Subject to any disclaimer, the term of this patent is extended or adjusted under 35 U.S.C. 154(b) by 0 days.

(21) Appl. No.: 13/607,920

(22) Filed: Sep. 10, 2012

(65) Prior Publication Data

US 2013/0062231 A1 Mar. 14, 2013

Related U.S. Application Data

(60) Provisional application No. 61/533,354, filed on Sep. 12, 2011.

(51) Int. Cl.

| | |
|---|---|
| ***A43B 3/24*** | (2006.01) |
| ***A43B 21/36*** | (2006.01) |
| ***A43B 21/433*** | (2006.01) |
| ***A43B 21/51*** | (2006.01) |

(52) U.S. Cl.
USPC ..... 36/100; 36/42; 36/36 C

(58) Field of Classification Search
USPC ..... 36/42, 36 C, 100, 36 R, 41
See application file for complete search history.

(56) References Cited

U.S. PATENT DOCUMENTS

| | | | | |
|---|---|---|---|---|
| 1,330,731 | A | 2/1920 | Walters et al. | |
| 2,187,167 | A | 1/1940 | Mayor | |
| 2,449,914 | A | 9/1948 | Simonetti | |
| 3,154,866 | A | 11/1964 | Laufbahn | |
| 3,797,136 | A | 3/1974 | Soleri | |
| 4,492,047 | A * | 1/1985 | Arff | 36/134 |
| 4,494,323 | A | 1/1985 | Latraverse | |
| 4,698,923 | A * | 10/1987 | Arff | 36/128 |
| 4,805,320 | A | 2/1989 | Goldenberg et al. | |
| 7,578,075 | B1 | 8/2009 | Kemp | |
| 8,069,538 | B2 * | 12/2011 | Wilcox | 24/109 |
| 8,132,341 | B1 * | 3/2012 | Laramore | 36/100 |
| 2001/0052195 | A1 | 12/2001 | Blakey | |
| 2004/0079001 | A1 | 4/2004 | McMullin | |
| 2006/0117601 | A1 | 6/2006 | Chang | |
| 2009/0236245 | A1 | 9/2009 | Meynard | |
| 2013/0019498 | A1 * | 1/2013 | Causey et al. | 36/42 |

FOREIGN PATENT DOCUMENTS

EP 1728448 A1 12/2006

OTHER PUBLICATIONS

International Search Report dated Jan. 31, 2013 for PCT/US12/54365.
Written Opinion dated Jan. 31, 2013 for PCT/US12/54365.

* cited by examiner

*Primary Examiner* — Ted Kavanaugh
(74) *Attorney, Agent, or Firm* — Burns & Levinson, LLP; Jacob N. Erlich, Esq.; Marlo Schepper Grolnic

(57) ABSTRACT

A removable heel assembly, a shoe having a removable shoe assembly and kit containing a shoe body having a heel base and a plurality a assorted removable and interchangeable heels. The heel assembly includes the heel base and a removable and interchangeable heel. The removability relies upon at east two curved, tapered grooves ending in a dimple. The heel utilizes a locking connector which contains components which fit within a cavity within the heel base and which locks in place upon rotation thereof when the components engage the curved, tapered, grooves and dimple.

18 Claims, 10 Drawing Sheets

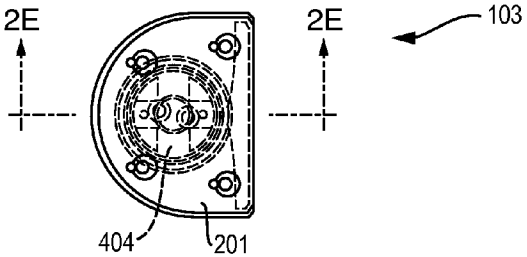
FIG. 2B
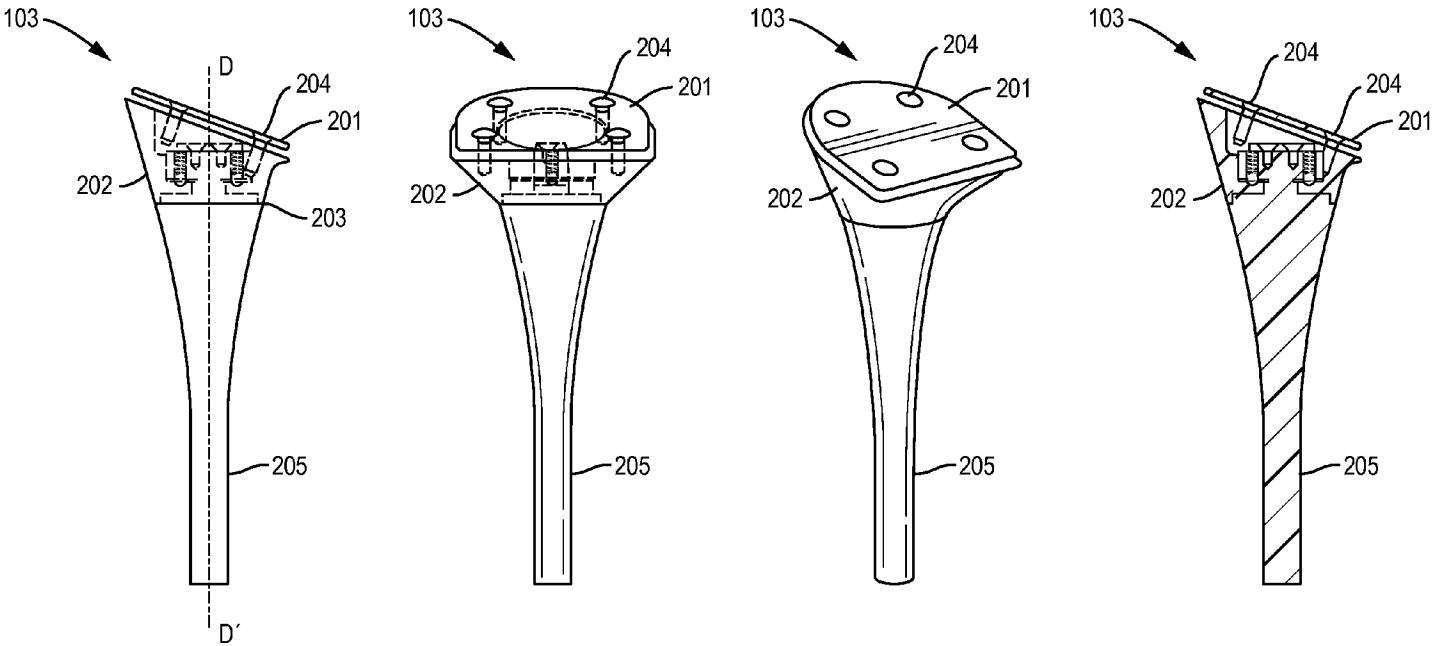
FIG. 2A
FIG. 2C
FIG. 2D
FIG. 2E

SHOE HAVING REMOVABLE AND INTERCHANGEABLE HEEL ASSEMBLIES WITH KIT

CROSS-REFERENCE TO RELATED APPLICATIONS

The present application claims priority to co-pending U.S. Provisional Patent Application No. 61/533,354, filed on Sep. 12, 2011, entitled REMOVABLE SHOE HEEL ASSEMBLY, which is incorporated herein by reference in its entirety and for all purposes.

BACKGROUND OF THE INVENTION

Through the selection of one's attire, one can choose to project a certain image or impression, whether professional, powerful, casual, approachable, fun-loving, athletic, etc. Essential tools in anyone's wardrobe are the shoes. Typically, one has different styled shoes for different "looks". Having different styles and colors for shoes can be an expensive undertaking. Further, providing different shoes for use in travel is even more expensive. For example, during travel, to anticipate needing different attires for different occasions, one typically has to carry multiple pairs of shoes. These shoes take up a disproportionate amount of luggage space and add to its weight. With most airlines charging baggage fees and imposing weight limits, saving luggage space and weight may prove to be advantageous.

Heretofore there has been a lack of providing for different shoes for different occasions, especially, shoes which can provide various heels of different sizes, configurations and colors, and to do so interchangeably in a safe manner.

BRIEF SUMMARY OF THE INVENTION

A removable and interchangeable heel assembly including a heel base, the heel base having a first surface and a second surface, a cavity formed within the heel base and having an opening within the second surface, the opening being of a predetermined configuration, an inner side of the second surface of the heel base having at least two curved, tapered grooves, each of the tapered grooves having a greater depth at one end thereof and a lesser depth at the other end thereof, and a dimple indentation at the other end of the tapered groove, a heel the dimple having a depth substantially the same or greater than the greater depth of the tapered groove, the heel being removably and interchangeably connected to the heel base, the heel having a first surface at one end thereof and a second surface at the other end thereof, a locking connector extending from the first surface of the heel and having a locking member of a predetermined configuration, said predetermined configuration of said locking member being substantially the same size as the second opening in the heel base, the locking member having an undersurface including at least two biased components extending therefrom, each of the biased components being configured such that it substantially at least partially fits within the tapered groove and dimple indentation, and the removable and interchangeable heel being rotatable within the cavity of the heel base, where upon insertion of the locking member within the opening until the first surface of the heel engages the second surface of the heel base, and upon rotation of the heel, each of the at least two biased components move within a respective, the curved, tapered groove from a greater depth to the lesser depth until each the biased component is biased within the respective, dimple indentation to lock the heel in place.

A shoe including a shoe body having a sole a heel assembly attached to a heel portion of the sole the heel assembly including a heel base; the heel base having a first surface and a second surface, the first surface of the heel base attached adjacent to an exterior of the heel portion of the sole, a cavity formed within the heel base, the cavity having an opening within the second surface, the second opening being of a predetermined configuration, an inner side of the second surface of the heel base having at least two curved, tapered grooves, each of the tapered grooves having a greater depth at one end thereof and a lesser depth at the other end thereof, and a dimple indentation at the other end of the tapered groove, a heel, the heel being removably and interchangeably connected to the heel base, the heel having a first surface at one end thereof and a second surface at the other end thereof, a locking connector extending from the first surface of the heel and having a locking member of a predetermined configuration, the predetermined configuration of the locking member being substantially the same size as the second opening in the heel base, the locking member having an undersurface including at least two biased components extending therefrom, each of the biased components being configured such that it substantially at least partially fits within each the tapered groove and dimple indentation, and the removable and interchangeable heel being rotatable within the cavity of the heel base, where upon insertion of the locking member within the opening until the first surface of the heel engages the second surface of the heel base, and upon rotation of the heel, each of the at least two biased components move within a respective, the curved, tapered groove from a greater depth to the lesser depth until each the biased component is biased within the respective, dimple indentation to lock the heel in place.

A kit having a box containing a shoe body, a plurality of removable and interchangeable heels, a support located within the box, the support having indentations therein, the indentations being configured to at least partially enclose the shoe body and the plurality of removable and interchangeable heels, the shoe body having a heel base attached thereto, and further, the following, the heel body having a first surface and a second surface, a cavity formed within the heel base, the cavity having an opening within the second surface, the second opening being of a predetermined configuration, an inner side of the second surface of the heel base having at least two curved, tapered grooves, each of the tapered grooves having a greater depth at one end thereof and a lesser depth at the other end thereof, and a dimple indentation at the other end of the tapered groove, each of the heels being removably and interchangeably connected to the heel base, each of the heels having a first surface at one end thereof and a second surface at the other end thereof a locking connector extending from the first surface of the heel and having a locking member of a predetermined configuration, the predetermined configuration of the locking member being substantially the same size as the second opening in the heel base, the locking member having an undersurface including at least two biased components extending therefrom, each of the biased components being configured such that it substantially at least partially fits within each the tapered groove and dimple indentation, and each the removable and interchangeable heel being rotatable within the cavity of the heel base, where upon insertion of the locking member within the opening until the first surface of each of the heel engages the second surface of the heel base, and upon rotation of each of the heel, each of the at least two biased components move within a respective, the curved, tapered groove from a greater depth to the lesser depth until each the biased component is biased within the respective, dimple indentation to lock each of the replaceable and interchangeable heel in place. The kit for containing a shoe body having a plurality of removable and interchangeable heels wherein each of the heels may be of a different color, size and configuration.

BRIEF DESCRIPTION OF THE SEVERAL VIEWS OF THE FIGURES

FIGS. 2A-2E illustrate in more detail various views of the removable heel assembly according to the present invention;

DETAILED DESCRIPTION OF THE INVENTION

One embodiment provides a shoe having a removable and interchangeable heel assembly. The removable and interchangeable heel assembly includes a heel base and a heel. Another embodiment is directed to the heel assembly. A further embodiment relates to a kit that is made up of box, a shoe body and the shoe body includes a heel base and a plurality of removable and interchangeable assorted heels. The following description is presented to enable one of ordinary skill in the art to make and use the invention and is provided in the context of a patent application and its requirements. Various modifications to the embodiment will be readily apparent to those skilled in the art and the generic principles herein may be applied to other embodiments. Thus, the present invention is not intended to be limited to the embodiments shown but is to be accorded the widest scope consistent with the principles and features described herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, elements, and/or components, but do not preclude the presence or addition of one or more other features, elements, components, and/or groups thereof.

Figure 1B:
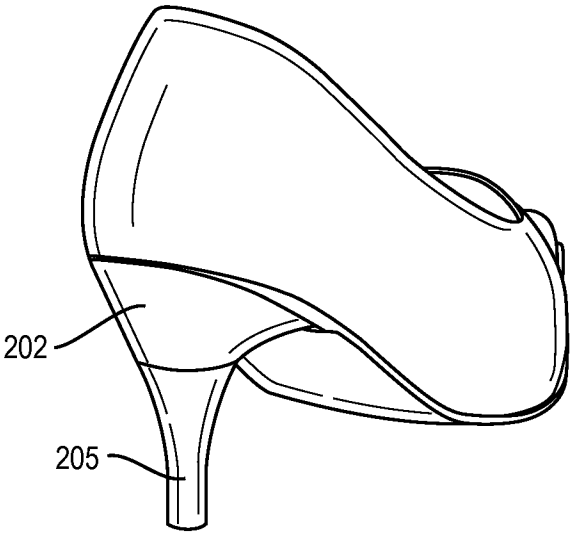
FIGS. 1A-1C illustrate embodiments of a removable heel assembly for a shoe according to the present invention.
Figure 1A:
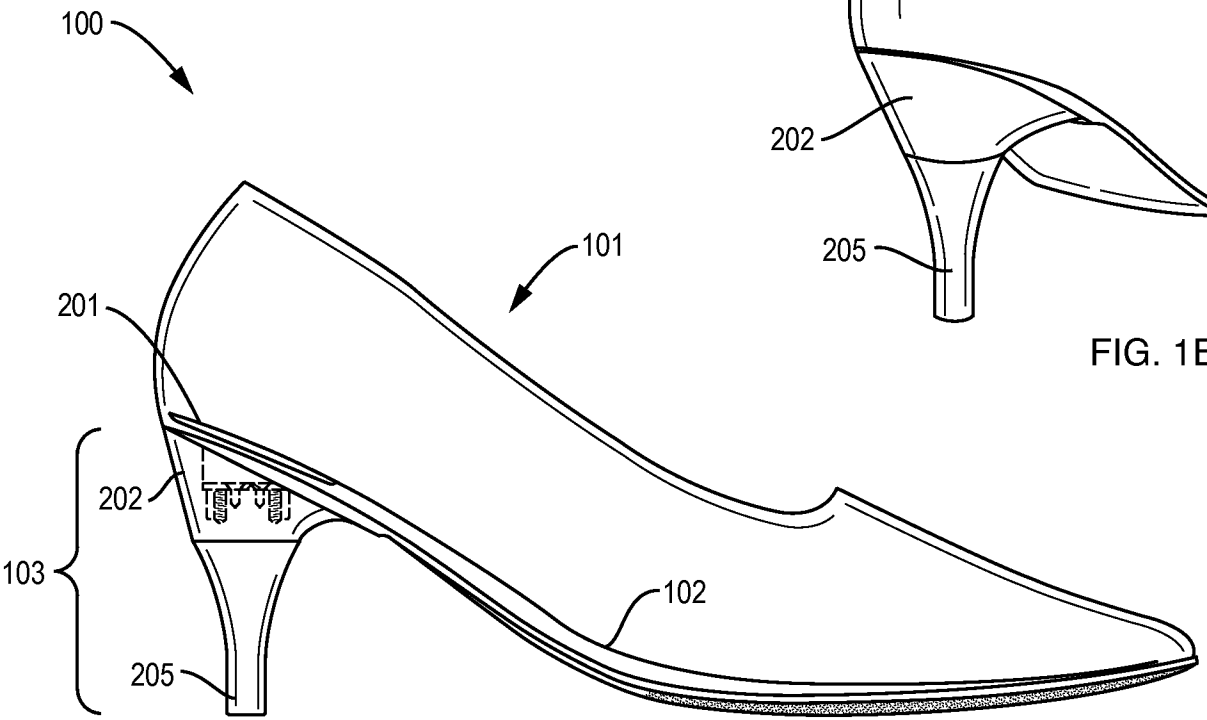
Figure 1C:
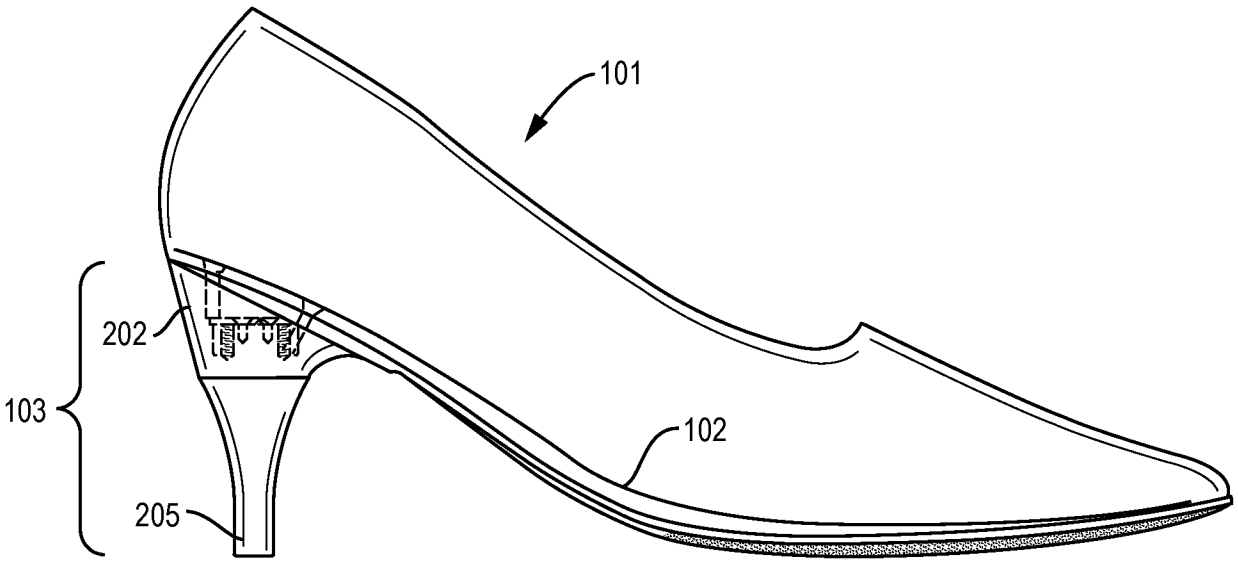

FIGS. 1A-C illustrate pictorial views of embodiments highlighting a shoe, shoe body and the removable heel assembly for a shoe according to the present invention. One embodiment, illustrated in FIG. 1A, comprises a shoe 100 made up of a shoe body 101, with a sole 102, detachably coupled to a removable heel assembly 103 at the heel area of the shoe body 101. The heel assembly 103 includes an internal heel mounting plate 201 residing under an inner sole liner of the shoe body 101, a heel base 202 for attachment thereto and a removable and replaceable heel 205. The heel base 202 may be made of various colors (for example, silver, gold, and other colors), materials, such as metals, composites, etc., but not limited to stainless steel, and configurations. The removable and replaceable heel 205 may also be made of various colors, materials, configurations and lengths. FIG. 1B illustrates pictorially from the rear, shoe 100 including heel assembly 103. In another embodiment, illustrated in FIG. 1C, the sole 102 is laminated with a material (such as, but not limited to, leather) over a core (such as, but not limited to, a steel core) (not shown). Here, the heel mounting plate 201 may not be needed as the heel assembly 103 may be detachably coupled directly to the base of the shoe body 101. The heel assembly 103 need not be permanently affixed to the shoe body 101, but instead can be decoupled from the shoe body 101 in the manner described below. The heel assembly 103 firmly attaches to the shoe body 101 so that the weight of a person wearing the shoe is safely supported.

FIGS. 2A-E illustrate in more detail an embodiment of the removable heel assembly 103 according to the present invention. The heel assembly 103 includes a heel inner mount or mounting plate 201, a heel base 202, a heel 205 containing a pin assembly 203 having a locking connector 503 and connector member 504, and fastening components described further below. In this embodiment, the heel inner mount 201 and the heel base 202 are affixed to the shoe body 101. The locking connector 503 and therefore the locking member of heel is not permanently affixed to the shoe body 101 but instead can be readily removed and be interchanged with respect to the heel base 202 in the manner described below.

Figure 3C:
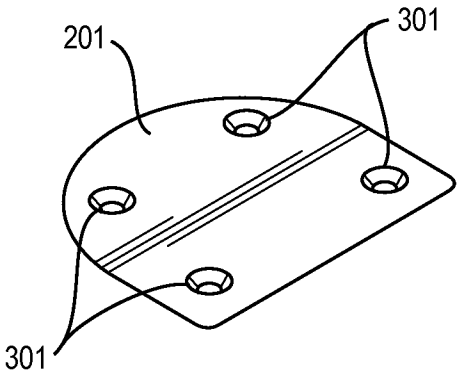
FIGS. 3A-3C illustrate in more detail various views of the heel inner mount of the removable heel assembly according to the present invention.
Figure 3B:
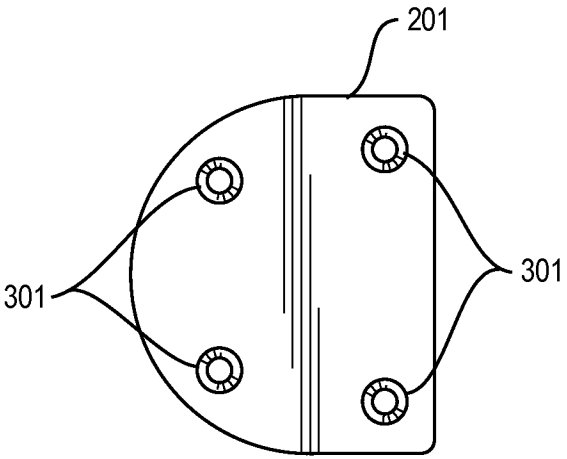
Figure 3A:
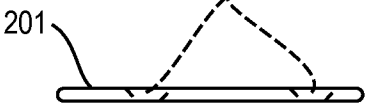
Figure 4A:
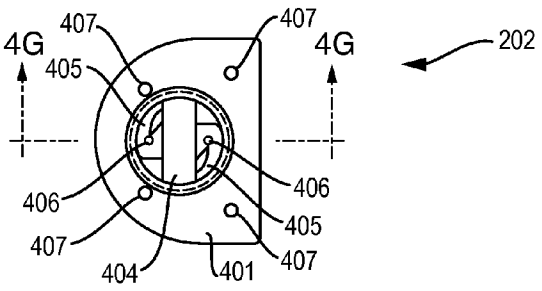
FIGS. 4A-4G illustrate in more detail various views of the heel base of the removable heel assembly according to the present invention.
Figure 4B:
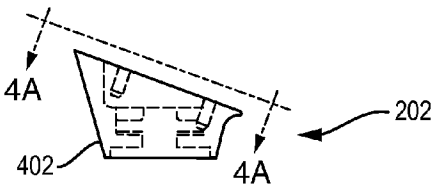
Figure 4C:
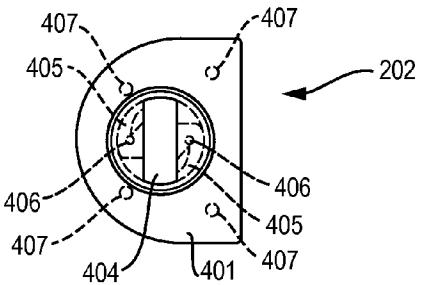
Figure 4D:
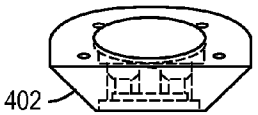
Figure 4E:
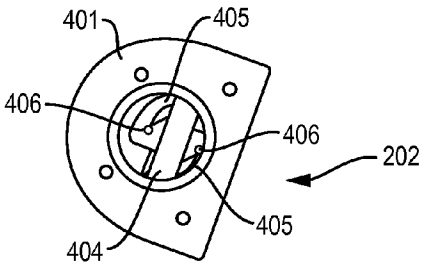
Figure 4F:
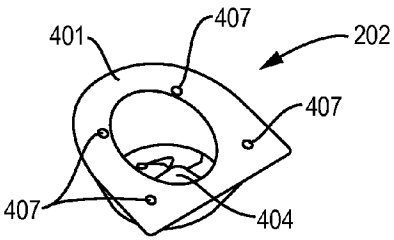
Figure 4G:
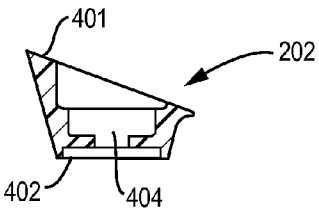
Figure 5B:
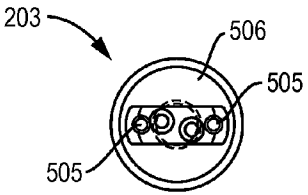
FIGS. 5A-5H illustrate in more detail various views of the pin assembly of the removable heel assembly according to the present invention.
Figure 5A:
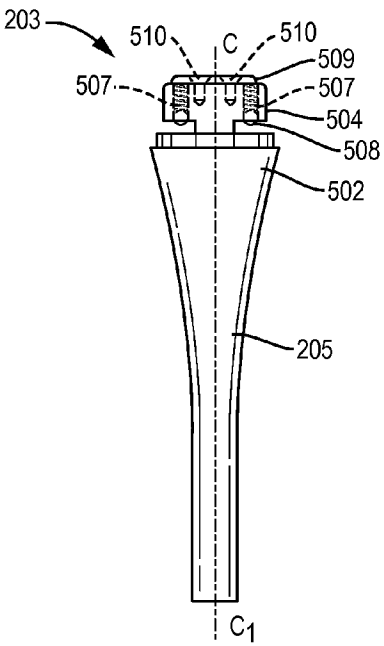
Figure 5C:
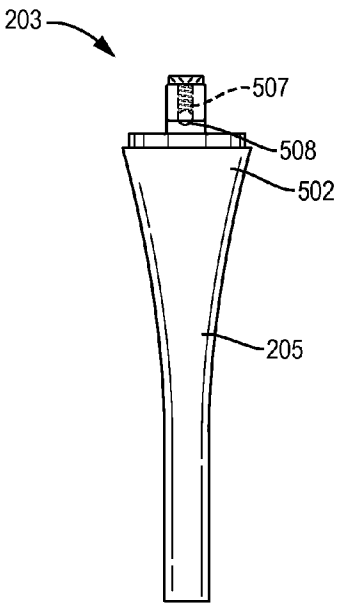
Figure 5D:
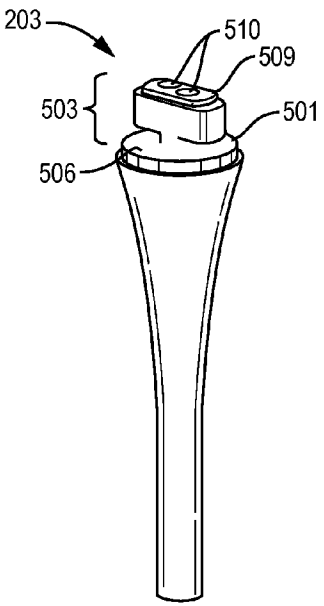
Figure 5F:
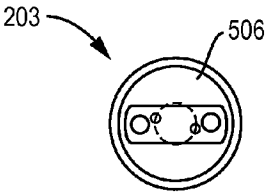
Figure 5E:
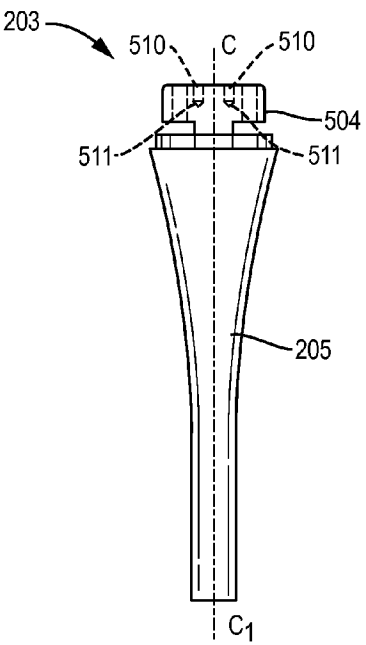
Figure 5G:
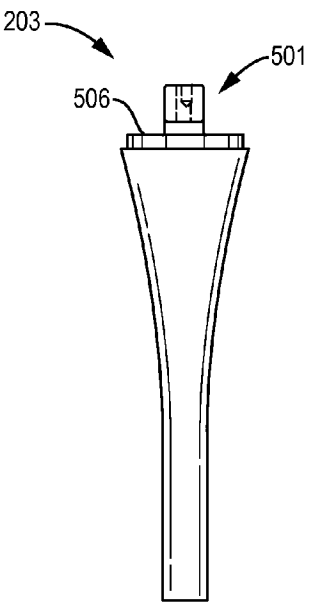
Figure 5H:
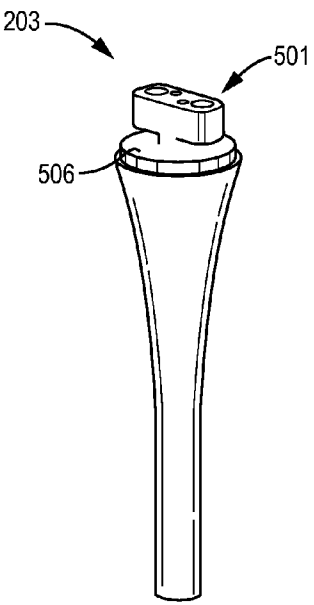
Figure 6A:
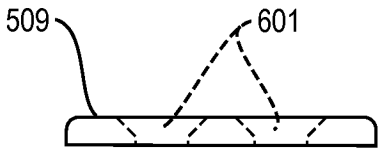
FIGS. 6A-6D illustrate in more detail various views of the heel pin cap of the pin assembly according to the present invention.
Figure 6B:
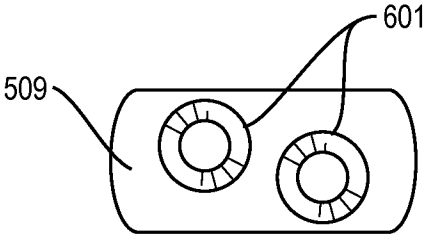
Figure 6C:
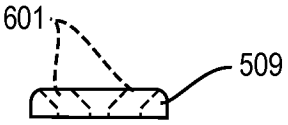
Figure 6D:
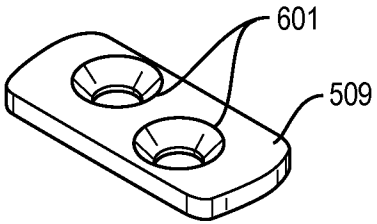
Figure 7B:
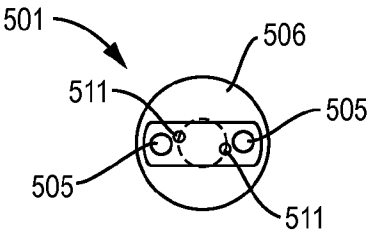
FIGS. 7A-7D illustrate in more detail various views of the heel pin of the pin assembly according to the present invention.
Figure 7C:
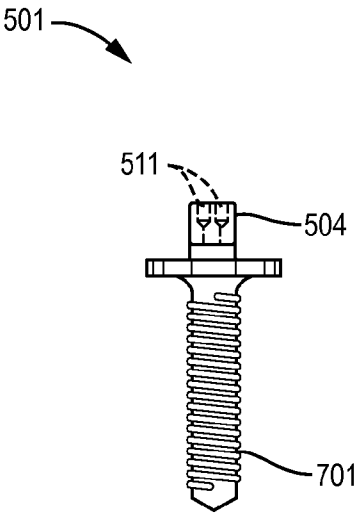
Figure 7D:
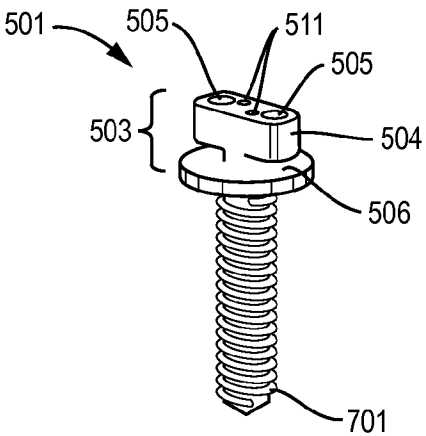
Figure 7A:
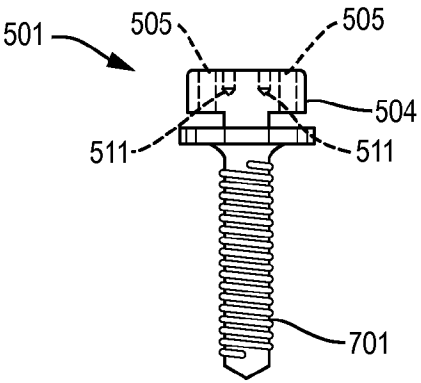

FIGS. 3A-C illustrate in more detail the embodiment of the heel inner mount or mounting plate 201 of the removable heel assembly 103 according to the present invention. The heel inner mount 201 resides within the shoe body 101 under the sole 102. The heel inner mount 201 provides a structure within the shoe body 101 for supporting and affixing of the heel base 202 of the heel assembly 103 thereto. Further, the surface of the heel inner mount 201 would reside under the heel portion of a wearer's foot, distributing the wearer's weight across the surface. As illustrates in FIG. 3B, the heel inner mount 201 includes a plate having a plurality of holes 301. In this embodiment, the heel inner mount 201 has, but is not limited thereto, four holes 301 for countersunk head screws (204, FIG. 2A). Preferably, each of the four holes 301, but not limited thereto, are beveled to accommodate the countersunk heads of the screws 204.

FIGS. 4A-G illustrate in more detail the embodiment of the heel base 202 of the removable heel assembly 103 according to the present invention. The heel base 202 comprises a first end 401 and a second end 402. The first end 401 comprises a plurality of internally threaded holes 407 for the screws 204. The screws 204 affix the heel base 202 to the heel inner mount 201 with the sole of the shoe 102 residing in-between. Alternative mechanisms for coupling the heel inner mount 201 and the heel base 202 may be used without departing from the spirit and scope of the present invention. As with the heel inner mount 201, the heel base 202 distributes the weight from the heel of the wearer over the surface of the first end 401. The second end 402 of the heel base 202 has a surface that abuts a surface of the pin assembly 203 (described further below) of heel 205. A cavity 403 traverses through the heel base 202 from the first end 401 to the second end 402. As an alternative, the cavity 403 may only open at the second end 402. At the second end 402, the cavity terminates adjacent an inner surface of second end 402 in a predetermined configured opening 404 having a predetermined shape to accommodate locking member 504 of locking connector 503 illustrated in more detail in FIGS. 5A-H. Along the inner surface of the second end 402 there is formed a lip portion. On the inner surface of the second end 402 and inside the cavity 403 are a pair, but not limited thereto, of curved, tapered indentations or grooves 405. Each of the tapered grooves 405 comprise deep portions or indentations of a predetermined depth proximate to the opening 404 and shallow portions of a depth less than the predetermined depth that are located distal to the opening 404 used to assist in locking the pin assembly 203 in place in a manner described in greater detail below. Proximate to or connected to the shallow ends of the tapered grooves 405 are cupped portions or dimples 406. The dimples 406 or indentations have a depth greater than the shallow end and substantially or even greater than the depth of the deep portion. In this embodiment, locking connector 503 or the pin assembly 203 has a connector member 504 that substantially matches the specific shape of the opening 404 and is inserted there through into the cavity 403 through the opening 404. Once so positioned, the heel 205 and therefore the locking connector 503 is rotated therein with ball bearings 508 in the tapered grooves 405 to lock into dimples 406 so as to engage and securely lock the heel 205 to the heel base 202 as described below.

FIGS. 5A-5H illustrate in more detail the pin assembly 203 of the removable heel 205. The pin assembly 203 comprises a heel pin 501/701 made of a solid material, such as, but not limited to steel or composite material (partially hidden) which is incorporated within heel 205. Part of the heel pin 501/701 resides within the pin assembly housing 502 and may be affixed therein by an adhesive, screwing or both, but not limited thereto. The pin assembly housing 502 provides the aesthetic shape of the heel 205 of the shoe. The heel pin 501 comprises locking connector 503 comprising a connector member 504, holes 505, an abutting surface 506, springs or biasing members 507, ball bearings 508 which extend partially from openings in the bottom of key 504, and a heel pin cap 509. The heel pin cap can be eliminated leaving a closed top surface. The shape of member 504 substantially matches the shape of the opening 404 of the heel base 202 such that the member 504 may fit and traverse through the opening 404 into the cavity 403 so as to be rotated therein. The locking member 504 may be uniquely shaped such that only a pin assembly with a member 504 substantially matching the shape of opening 404 may be used with the heel base 202. The holes 505 traverse the member 504 either all the way through and are capped or otherwise manufactured in a conventional manner, or only partially therethrough along the C-C' axis. The springs 507 reside within the holes 505 and compress along the C-C' axis (see FIGS. 5A and B). The ball bearings 508 also reside within the holes 505 and are coupled to the springs 507 at the ends proximate to the abutting surface 506. The ball bearings 508 partially protrude from the holes 505 when the springs 507 by the force generated by the compressed springs so as to engage the dimples 406. The holes end openings 505 are slightly smaller than the ball bearings 508 so that the ball bearings 508 do not fall out of the holes 505. As illustrated in FIGS. 6A-D, the heel pin cap 509, if utilized, includes a plate having a plurality of holes 601 that traverse through the heel pin cap 509. Screws 510 (FIG. 5A) are inserted through the holes 601 of the heel pin cap 509. Another plurality of internally threaded holes 511 partially traverse through the member 504 (see FIGS. 5E-H). The holes 511 are positioned to align with the holes 601 in the heel pin cap 509, such that when the screws 510 are inserted through the holes 511 and $01, the heel pin cap 509 securely abuts the springs 507 at the ends opposite the ball bearings 508, giving the springs 507 a surface upon which to compress. Alternative mechanisms for coupling the heel pin cap 509 to the key 504 may be used without departing from the spirit and scope of the present invention.

FIGS. 7A-D illustrate in more detail the heel pin 501 of the pin assembly. The heel pin 501 comprises the locking connector 503, the abutting surface 506, and a heel pin shaft 701 threaded at an end distal to the abutting surface 506. Matching internal threads exist within the pin assembly housing 502 (not shown) of heel 205, although it should be realized that an adhesive may be used instead or in conjunction therewith. When the threads of the heel pin shaft 701 engage the threads within the pin assembly housing 502, the heel pin shaft 701 securely fastens the heel pin 501 to the housing 502.

Referring to all views of FIGS. 2, 4, and 5, when the heel 205 is attached to the heel base 202, the member 504 of the heel pin 501 resides within the cavity 403 of the heel base 202. The screws or other fastening components 204 are used to attach the heel mounting plate to the heel base of heel assembly 103, to attach the heel 205 to heel base 202, the member 504 is inserted through the opening 404 of the heel base 202, and the pin assembly 203 is rotated along the D-D' axis (FIG. 2A). During the rotation, the ball bearings 508 travel within the grooves 405 starting from the deep ends to the shallow ends. As the ball bearings 508 move, the fit between the pin assembly 203 and the heel base 202 become increasingly tighter, and the springs 507 become increasingly compressed. When the ball bearings 508 "fall" into the dimples 406, the rotation of the pin assembly 203 stops, the compression of springs 507 hold the ball bearings 508 securely within the dimples 406. Thus, through the combination of the tightness between the abutting surface of the pin assembly 203 and the second end 402 of the heel base 202, and the ball bearings 508 being held within the dimples 406 by the springs 507, the pin assembly 203 becomes locked to the heel base 202. The level of force of this lock may be based on a combination of the amount of depth of the grooves 405, the tension of the springs 507, the strength of the ball bearings 508, and the space clearance between the key 504 and the abutting surface 506. In one embodiment, the locking force is such that the pin assembly 203 will not twist out of, or dislodge from, the heel base 202 during normal use of the shoe.

Although the embodiment of the present invention is illustrated in FIG. 2 with the member 504 rotated 90° to reach the locking position, any amount of rotation may be used without departing from the spirit and scope of the present invention.

A removable heel assembly for a shoe has been disclosed wherein the heel base 202 of the heel assembly 103 is generally fixed to the shoe body and the heel 205 can be easily removed and attached (interchangeability) to the heel base 202 in a very secure and save manner. With the heel assembly 103 according to the present invention, a wearer can interchange heels 205 with different aesthetic designs, configurations, materials, lengths and/or colors with the same shoe body 101. This gives the wearer the flexibility to choose shoe styles by changing the heel 205. When traveling, the wearer can pack one shoe body having a removable heel assembly and multiple removable and interchangeable heels 205 to accommodate attire for different occasions, varying colors, designs, material, size and length, while saving luggage space.

Figure 8:
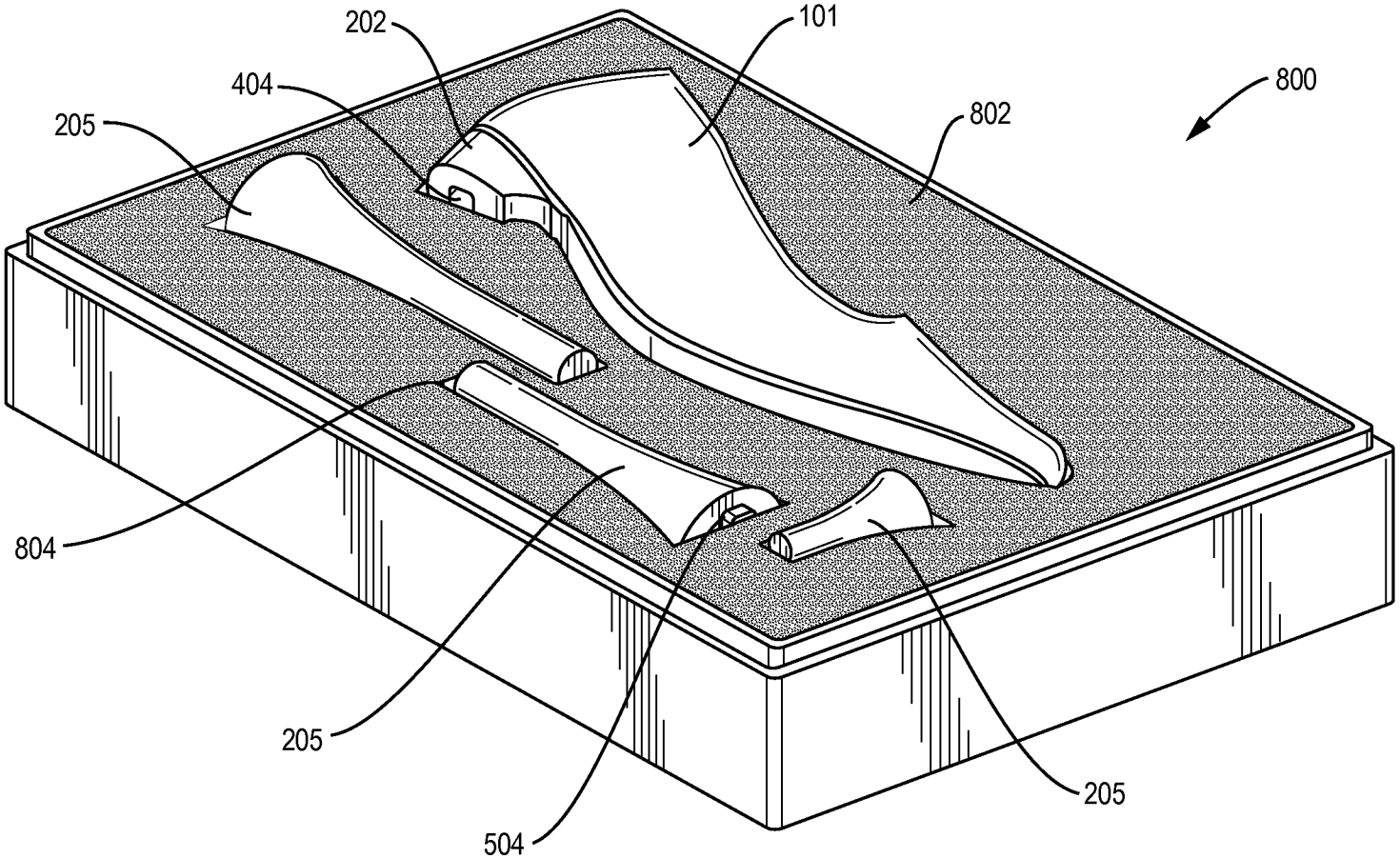
FIG. 8 illustrates a kit containing a shoe body, heel body and a plurality of heel portions.

A kit 800 as shown in FIG. 8 which may come with, but is not limited to, a shoe body 101 having an attached heel base 202 and multiple heels 205. For the embodiments described above, the wearer is not required to carry any specially designed keys for attachment and removal of the heels. Furthermore, as shown in FIG. 8, the kit 800 is made up of a support structure 802 having inserts 804 and made of but not limited to, foam or plastic, for example, and may be provided with one or more shoe bodies 101 having different heel bases 202 and shoe heels 205, if so desired.

Although the present invention has been described in accordance with the embodiments shown, one of ordinary skill in the art will readily recognize that there could be variations to the embodiments and those variations would be within the spirit and scope of the appended claims. Accordingly, many modifications may be made by one of ordinary skill in the art without departing from the spirit and scope of the appended claims.

What is claimed is:

1. A removable and interchangeable heel assembly, comprising:

a heel base; said heel base having a first surface and a second surface;

a cavity formed within said heel base and having at least an opening within said second surface of said heel assembly, said at least an opening within said second surface of said heel assembly being of a predetermined configuration;

an inner side of said second surface, adjacent said cavity of said heel base, having at least two curved, tapered grooves, each of said tapered grooves having a greater depth at one end thereof and a lesser depth at the other end thereof, and a dimple indentation at said other end of said tapered groove;

a heel, said heel being removably and interchangeably connected to said heel base;

said heel having a first surface at one end thereof and a second surface at the other end thereof;

a locking connector extending from said first surface of said heel and having a locking member of a predetermined configuration, said predetermined configuration of said locking member being substantially the same size as said predetermined size of said opening in said heel base;

said locking member having an undersurface including at least two biased components extending therefrom, each of said at least two biased components being configured such that it substantially, at least partially fits within said tapered groove and dimple indentation; and said removable and interchangeable heel being rotatable within said cavity of said heel base, wherein upon insertion of said locking member within said opening until said first surface of said heel engages said second surface of said heel base, and upon rotation of said heel, each of said at least two biased components move within a respective, said curved, tapered groove from a greater depth to the lesser depth until each of said at least two biased components is biased within a respective, dimple indentation to lock the heel in place.

2. The removable and interchangeable heel assembly as defined in claim 1, wherein said locking member has at least two openings through which each of said at least two biased components, respectively, extends, and a biasing element juxtaposed each said at least two biased components and located within said locking member.

3. The removable and interchangeable heel assembly as defined in claim 1, further comprising:

a mounting plate, said mounting plate having removable securing elements associated therewith for removably securing said mounting plate to said first surface of said heel base.

4. The removable and interchangeable heel assembly as defined in claim 2, wherein said inner side of said second surface of said heel base has a lip-like configuration, said lip-like configuration having said at least two curved, tapered grooves on opposite sides thereof.

5. The removable and interchangeable heel assembly as defined in claim 1, wherein said locking member of said locking connector having a substantially flat portion extending from and formed from said undersurface of said locking member to constitute said first surface of said heel which engages said second surface of said heel base, and said flat portion further including a securing member extending therefrom which secures said locking connector to said heel.

6. The removable and interchangeable heel assembly as defined in claim 1, wherein said heel base has another opening adjacent said cavity, said another opening being located within said first surface of said heel base.

7. The removable and interchangeable heel assembly as defined in claim 5, wherein said securing member extending from said extension portion comprises a pin;

said heel having an opening therein wherein said pin fits therein; and means for securing said pin within said opening in said heel to aid in the stability of said removable and interchangeable heel.

8. The removable and interchangeable heel assembly as defined in claim 7, wherein said pin has threads thereon and said opening within said heel is internally threaded.

9. The removable and interchangeable heel assembly as defined in claim 8, wherein an adhesive is located within said opening in said heel.

10. A shoe, comprising:

a shoe body;

a heel assembly attached to a heel portion of said shoe body;

said heel assembly including a heel base; said heel base having a first surface and a second surface, said first surface of said heel base attached adjacent to an exterior of said heel portion of said shoe body;

a cavity formed within said heel base, said cavity having at least an opening within said second surface of said heel assembly, said at least an opening in said second surface being of a predetermined configuration;

an inner side of said second surface of said heel base having at least two curved, tapered grooves, each of said tapered grooves having a greater depth at one end thereof and a lesser depth at the other end thereof, and a dimple indentation at said other end of said tapered groove;

a heel, said heel being removably and interchangeably connected to said heel base;

said heel having a first surface at one end thereof and a second surface at the other end thereof;

a locking connector extending from said first surface of said heel and having a locking member of a predetermined configuration, said predetermined configuration of said locking member being substantially the same size as said predetermined size of said opening in said second heel base;

said locking member having an undersurface including at least two biased components extending therefrom, each of said at least two biased components being configured such that it substantially at least partially fits within each said tapered groove and dimple indentation; and said removable and interchangeable heel being rotatable within said cavity of said heel base, where upon insertion of said locking member within said opening until said first surface of said heel engages said second surface of said heel base, and upon rotation of said heel, each of said at least two biased components move within a respective, said curved, tapered groove from a greater depth to the lesser depth until each of said at least two biased component is biased within the respective, dimple indentation to lock the heel in place.

11. The shoe as defined in claim 10, wherein said locking member has at least two openings through which each of said at least two biased components, respectively, extends, and a biasing element juxtaposed each said at least two biased components and located within said locking member.

12. The shoe as defined in claim 10, further comprising:

a mounting plate, said mounting plate being located within said shoe body;

said mounting plate having removable securing elements associated therewith for removably securing said mounting plate to said first surface of said heel base in order to removably attach said heel assembly to said shoe body.

13. The shoe as defined in claim 12, wherein said inner side of said second surface of said heel base has a lip-like configuration, said lip-like configuration having said at least two curved, tapered grooves on opposite sides thereof.

14. The shoe as defined in claim 10, wherein said locking member of said locking connector having a substantially flat portion extending from said undersurface of said locking member to constitute said first surface of said heel which engages said second surface of said heel base, and said flat portion further including a securing member which secures said locking connector to said heel.

15. The shoe as defined in claim 10 wherein said heel base has another opening adjacent said cavity, said another opening being located within said first surface of said heel base.

16. The shoe as defined in claim 14, wherein said securing member extending from said extension portion comprises a pin;

said heel having an opening therein wherein said pin fits therein; and means for securing said pin within said opening in said heel to aid in the stability of said removable and interchangeable heel.

17. The shoe as defined in claim 16, wherein said pin has threads thereon and said opening within said heel is internally threaded.

18. The shoe as defined in claim 17, wherein an adhesive is located within said opening in said heel.

* * * * *